US011389920B2

(12) United States Patent
Sekiya

(10) Patent No.: US 11,389,920 B2
(45) Date of Patent: Jul. 19, 2022

(54) CUTTING APPARATUS

(71) Applicant: DISCO CORPORATION, Tokyo (JP)

(72) Inventor: Kazuma Sekiya, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 900 days.

(21) Appl. No.: 16/128,874

(22) Filed: Sep. 12, 2018

(65) Prior Publication Data

US 2019/0076981 A1 Mar. 14, 2019

(30) Foreign Application Priority Data

Sep. 14, 2017 (JP) ..... JP2017-176633

(51) Int. Cl.
*B24B 27/06* (2006.01)
*B24B 53/007* (2006.01)
*B24B 49/12* (2006.01)

(52) U.S. Cl.
CPC ..... *B24B 27/0683* (2013.01); *B24B 49/12* (2013.01); *B24B 53/007* (2013.01)

(58) Field of Classification Search
CPC ... B24B 27/0683; B24B 27/06; B24B 53/007; B24B 49/12; B24B 49/183; B24B 55/02; B28D 5/0076; B28D 7/02
USPC ..... 451/6, 41, 178, 182, 444
See application file for complete search history.

(56) References Cited

U.S. PATENT DOCUMENTS 4,558,686 A * 12/1985 Ono ..... B23Q 11/005 125/13.01
6,105,567 A * 8/2000 Sun ..... H01L 21/78 125/13.01
6,692,339 B1 * 2/2004 Halley ..... B24B 37/042 451/41
7,495,759 B1 * 2/2009 Cheng ..... B23D 59/001 356/237.1
2001/0035535 A1 * 11/2001 Hayashi ..... H01L 21/67092 257/200
2002/0106972 A1 * 8/2002 Lebel ..... H01L 21/681 451/5
2002/0168921 A1 * 11/2002 Adachi ..... B28D 5/0076 451/5
2003/0045207 A1 * 3/2003 Taylor ..... B24B 53/017 451/6

(Continued)

FOREIGN PATENT DOCUMENTS

JP 01209104 A 8/1989
JP 2009083077 A 4/2009
WO WO-2009046960 A1 * 4/2009 ..... G01B 11/0675

OTHER PUBLICATIONS

Muth et al; WO-2009046960-A1, Apr. 16, 2009, machine translation (Year: 2009).*

*Primary Examiner* — Eileen P Morgan
*Assistant Examiner* — Marcel T Dion
(74) *Attorney, Agent, or Firm* — Greer Burns & Crain, Ltd.

(57) ABSTRACT

A cutting apparatus is provided with a cutting unit. The cutting unit includes a spindle on which a cutting blade is mounted for rotation, a spindle housing that rotatably supports the spindle, a blade cover that is attached to the spindle housing and covers the cutting blade, a cutting water supply nozzle that supplies cutting water to the cutting blade, and a blade monitor that has an end face configured to monitor a cutting edge of the cutting blade. The end face of the blade monitor has a recessed portion to which rinsing water is supplied to rinse the end face.

11 Claims, 5 Drawing Sheets

(56) References Cited

U.S. PATENT DOCUMENTS

| | | | | |
|---|---|---|---|---|
| 2003/0119424 | A1* | 6/2003 | Ahmadi | B08B 7/0092 451/39 |
| 2004/0242121 | A1* | 12/2004 | Hirokawa | B24B 49/12 451/5 |
| 2011/0165823 | A1* | 7/2011 | Ide | B24B 37/00 451/41 |
| 2019/0137626 | A1* | 5/2019 | Dietz | B24B 7/228 |
| 2019/0193242 | A1* | 6/2019 | Takahashi | B24B 49/12 |

* cited by examiner

CUTTING APPARATUS

BACKGROUND OF THE INVENTION

Field of the Invention

The present invention relates to a cutting apparatus provided with a blade monitor that monitors a cutting blade.

Description of the Related Art

A wafer with a plurality of devices such as integrated circuits (ICs) or large scale integrations (LSIs) formed on its surface divided by planned dividing lines is divided into individual device chips by a cutting apparatus, and the divided device chips are used in electrical equipment such as mobile phones or personal computers.

A cutting apparatus is configured from at least a chuck table that holds a workpiece, a cutting unit that subjects the workpiece, which is held on the chuck table, to cutting by rotating a cutting blade provided with a cutting edge on a periphery thereof while supplying cutting water to the workpiece, and a machining feed unit that subjects the chuck table and the cutting unit to machining feed relative to each other, and can accurately divide the workpiece, for example, a semiconductor wafer into individual device chips.

More sophisticated types of cutting apparatus have also been proposed including those which have a function to interrupt cutting if a cutting blade develops chipping or wearing at a cutting edge thereof. These more sophisticated types of cutting apparatus include a light-emitting end face, which emits light of a light-emitting element, and a light-receiving end face, which receives the light emitted from the light-emitting end face and guides it to a light-receiving element, arranged with the cutting edge interposed therebetween and detect changes in the quantity of received light to monitor the conditions of the cutting edge; or include an image capture camera to monitor the conditions of the cutting edge (see, for example, Japanese Patent Laid-Open No. 2009-083077 and Japanese Patent No. 2627913).

SUMMARY OF THE INVENTION

According to the cutting apparatus described in Japanese Patent Laid-Open No. 2009-083077 or Japanese Patent No. 2627913, the conditions of the cutting edge of the cutting blade can be monitored based on the quantity of light received at the light-receiving element or an image captured by the image capture camera, whereby chipping or wearing can be detected to achieve the interruption of the cutting as needed. However, swarf occurs during the cutting, and mixes in cutting water scattered subsequent to its supply in a vicinity of the cutting edge. As the light-emitting end face of the light-emitting element and the light-receiving end face of the light-receiving element or an end face of the image capture camera are arranged close to the cutting edge, the swarf contained in the cutting water scattered from the cutting edge adheres the respective end faces. If swarf adheres as described above, the detection of an accurate quantity of light based on the light-emitting element and the light-receiving element or the capture of an image of the cutting edge by the image capture camera is interfered. Even if the cutting edge of the cutting blade undergoes chipping or wearing, the cutting cannot be interrupted as needed, thereby developing a problem that the quality of the cutting may be affected.

Therefore, the present invention has as an object thereof the provision of a cutting apparatus that can suppress adhesion of swarf, which is mixed in cutting water, on an end face of at least one of a light-emitting element and a light-receiving element, an image capture camera, or the like.

In accordance with an aspect of the present invention, there is provided a cutting apparatus including a chuck table that holds a workpiece, a cutting unit that subjects the workpiece, which is held on the chuck table, to cutting by rotating a cutting blade while supplying cutting water to the workpiece, and a machining feed unit that subjects the chuck table and the cutting unit to machining feed relative to each other. The cutting unit includes a spindle with a cutting blade mounted thereon for rotation, a spindle housing that rotatably supports the spindle, a blade cover that is attached to the spindle housing and covers the cutting blade, a cutting water supply nozzle that supplies cutting water to the cutting blade, and a blade monitor that has an end face configured to monitor a cutting edge of the cutting blade. The end face of the blade monitor has a recessed portion to which rinsing water is supplied to rinse the end face.

Preferably, the rinsing water may be supplied when rotation of the cutting blade is stopped. Preferably, the rinsing water may include one of diluted fluoric acid and a surfactant.

According to the present invention, it is configured that the end face of the blade monitor has the recessed portion and the rinsing water, which rinses the end face, is supplied to the recessed portion, and therefore it is possible to suppress the adhesion of swarf, which is mixed in the cutting water through rinsing of the end face of the blade monitor, and to prevent such swarf from impeding the monitoring of the cutting edge of the cutting blade.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
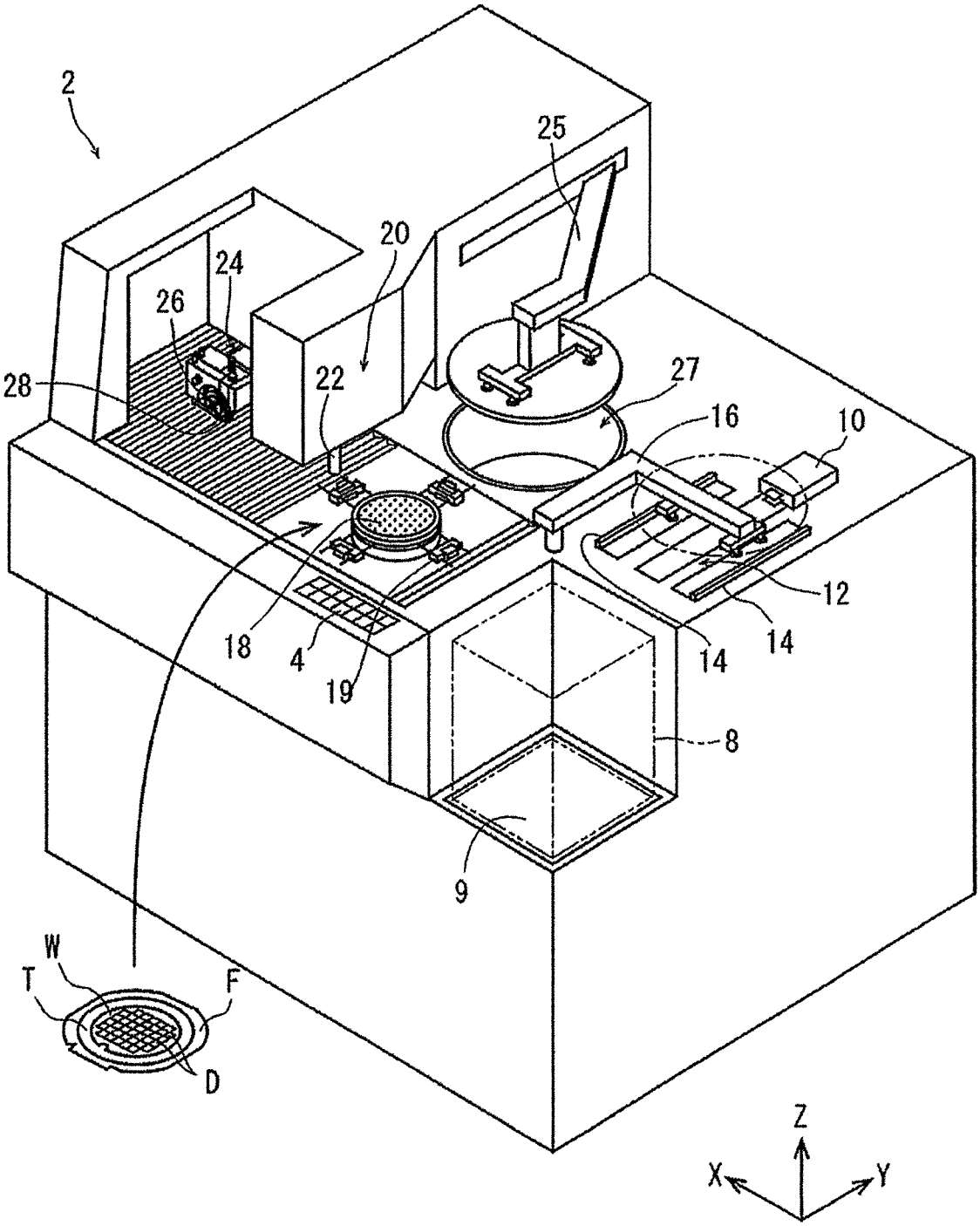
FIG. 1 is a perspective view of a cutting apparatus according to an embodiment of the present invention.

About a cutting apparatus according to an embodiment of the present invention, a detailed description will hereinafter be made with reference to the drawings. FIG. 1 depicts an overall perspective view of a cutting apparatus 2 that can perform dicing of a wafer to divide the wafer into individual device chips.

On a front side of the cutting apparatus 2, operation means (operation control panel) 4 is disposed to allow an operator to input instructions such as machining conditions and the like for the apparatus. As depicted in the figure, a wafer W as a workpiece is bonded on a dicing tape T, and the dicing tape T is bonded at a peripheral edge portion thereof on a frame F. As a consequence, the wafer W is in a state of being supported on the frame F via the dicing tape T, and a plurality of wafers (for example, 25 wafers) are placed in a wafer cassette 8 depicted in FIG. 1. On a surface of the wafer W, planned dividing lines which are set to intersect at right angles are formed, and devices D are formed in plural regions divided by the planned dividing lines. The wafer cassette 8 is mounted on a cassette elevator 9 that is movable upward and downward.

Behind the wafer cassette 8, a transfer in/out unit 10 is arranged to transfer each wafer W out of the wafer cassette 8 before cutting and to transfer it back into the wafer cassette 8 after cutting. Between the wafer cassette 8 and the transfer in/out unit 10, a temporary placing region 12 is arranged, where each wafer transferred out or to be transferred in is temporarily placed. At the temporary placing region 12, registration units 14 are arranged to bring the wafer W into registration with a predetermined location.

In a vicinity of the temporary placing region 12, a transfer unit 16 is arranged with a swing arm that holds the frame F integrated with the wafer W under suction and transfers them. The wafer W transferred out to the temporary placing region 12 is held under suction by the transfer unit 16, and is transferred onto a chuck table 18 configured as holding means. The wafer W is then sucked on the chuck table 18 and the frame F is fixed by a plurality of clamps 19, whereby the wafer W is held on the chuck table 18.

The chuck table 18 is configured to be rotatable and also to be reciprocally movable by a processing feed unit (not depicted) in an X-axis direction, that is, a processing feed direction. Above a moving path for the chuck table 18 in the X-axis direction, an alignment unit 20 is arranged to detect planned dividing lines along which the wafer W should be cut.

The alignment unit 20 includes an image capture unit 22 that captures an image of a surface of the wafer W, and based on the image captured by the image capture unit 22, the planned dividing lines along which cutting should be conducted can be detected by processing such as pattern matching. The image captured by the image capture unit 22 is displayed on undepicted display means.

On a left side of the alignment unit 20, a cutting unit 24 is arranged. The cutting unit 24 subjects the wafer W, which is held on the chuck table 18, to cutting. The cutting unit 24 is configured integrally with the alignment unit 20, and both of these units move together in a Y-axis direction and a Z-axis direction.

The cutting unit 24 is configured with a cutting blade 28 mounted on a free end of a rotatable spindle 26, and is movable in the Y-axis direction and the Z-axis direction. The cutting blade 28 is located on an extension of the image capture unit 22 in the X-axis direction.

Figure 2A:
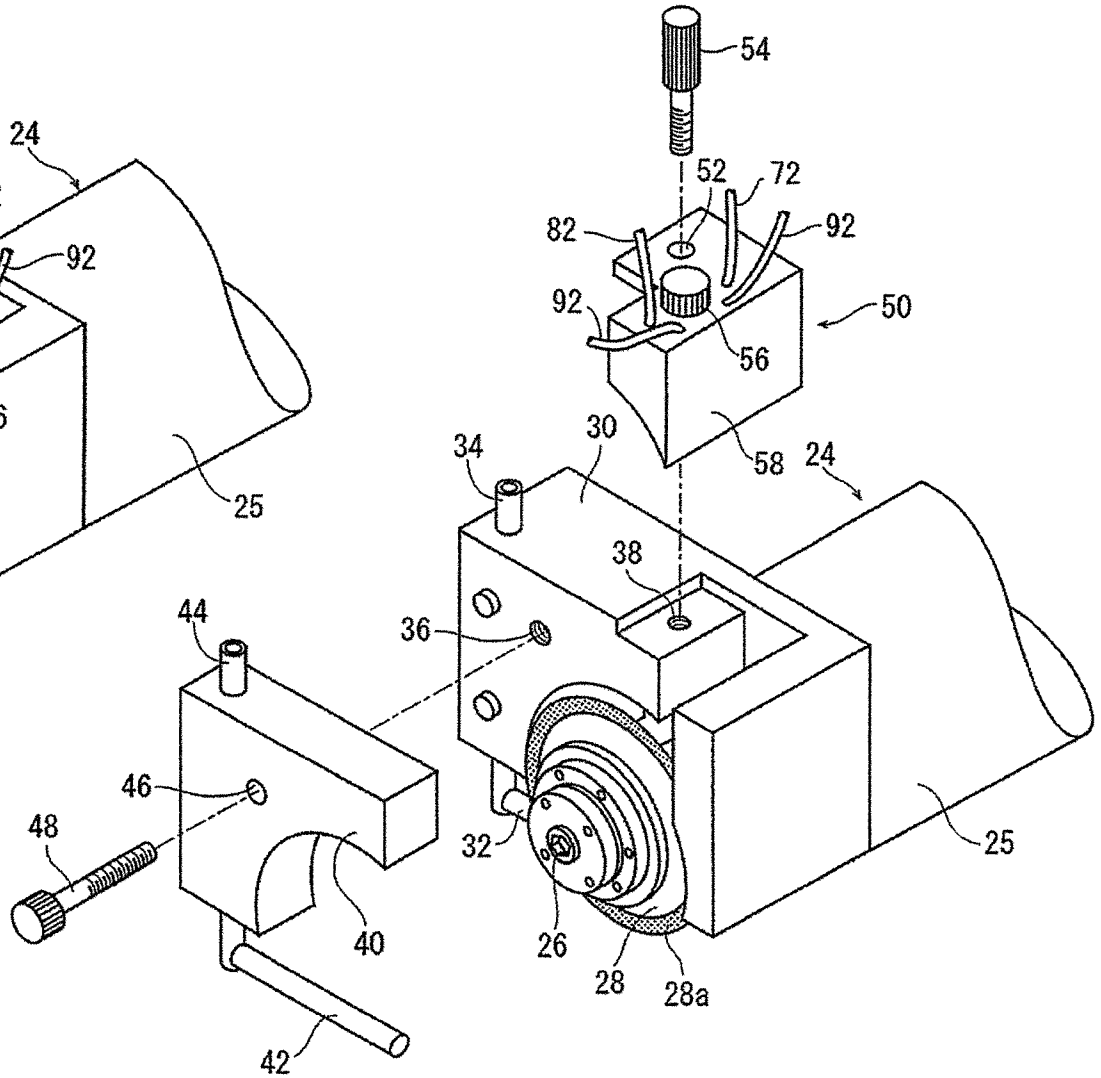
FIG. 2A is an exploded perspective view of a cutting unit disposed in the cutting apparatus depicted in FIG. 1.
Figure 2B:
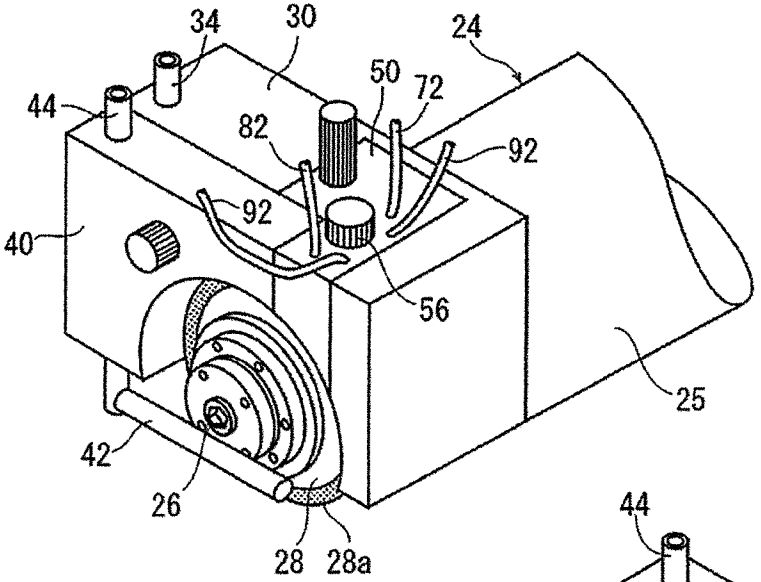
FIG. 2B is a perspective view of the cutting unit.

FIG. 2A depicts an exploded perspective view of the cutting unit 24. FIG. 2B is a perspective view of the cutting unit 24 assembled from a state depicted in FIG. 2A. The cutting unit 24 includes a spindle housing 25, in which the spindle 26 rotationally drivable by an undepicted servomotor is rotatably supported. The cutting blade 28 is, for example, an electroformed blade, and has on a peripheral portion thereof a cutting edge 28*a* with diamond abrasive grains distributed in a nickel matrix.

The cutting unit 24 includes a blade cover 30 that covers the cutting blade 28, and a detachable cover 40 and a blade monitor 50 that are detachably attached to the blade cover 30.

To the blade cover 30, a cutting water supply nozzle 32 is attached extending along a rear side wall of the cutting blade 28. Cutting water is supplied to the cutting water supply nozzle 32 from above the blade cover 30 via a pipe 34. The blade cover 30 has screw holes 36 and 38.

The detachable cover 40 has another cutting water supply nozzle 42, which extends along a front side wall of the cutting blade 28 when the detachable cover 40 has been attached to the blade cover 30. Cutting water is supplied to the cutting water supply nozzle 42 from above via a pipe 44.

The detachable cover 40 is fixed on the blade cover 30 by inserting a screw 48 into a round hole 46 of the detachable cover 40 and bringing it into threaded engagement with the screw hole 36 of the blade cover 30. As a consequence, the cutting blade 28 is covered at a substantially upper half thereof by the blade cover 30 and detachable cover 40 as depicted in FIG. 2B.

Referring to FIGS. 2A through 5, a description will be made about the configuration of the blade monitor 50. The blade monitor 50 includes a fixed block 58 fixedly secured on the blade cover 30, and a moving block 60 movable upward and downward relative to the fixed block 58 (see FIG. 3). The blade monitor 50 is attached to the blade cover 30 by inserting a screw 54 into a round hole 52 of the fixed block 58 and bringing it into threaded engagement with the screw hole 38 of the blade cover 30.

An adjustment screw 56 is mounted on the fixed block 58, and is in threaded engagement with an undepicted, internally-threaded portion formed in the moving block 60. When the adjustment screw 56 is rotated, the moving block 60 moves upward or downward relative to the fixed block 58 according to the turning direction.

Figure 3:
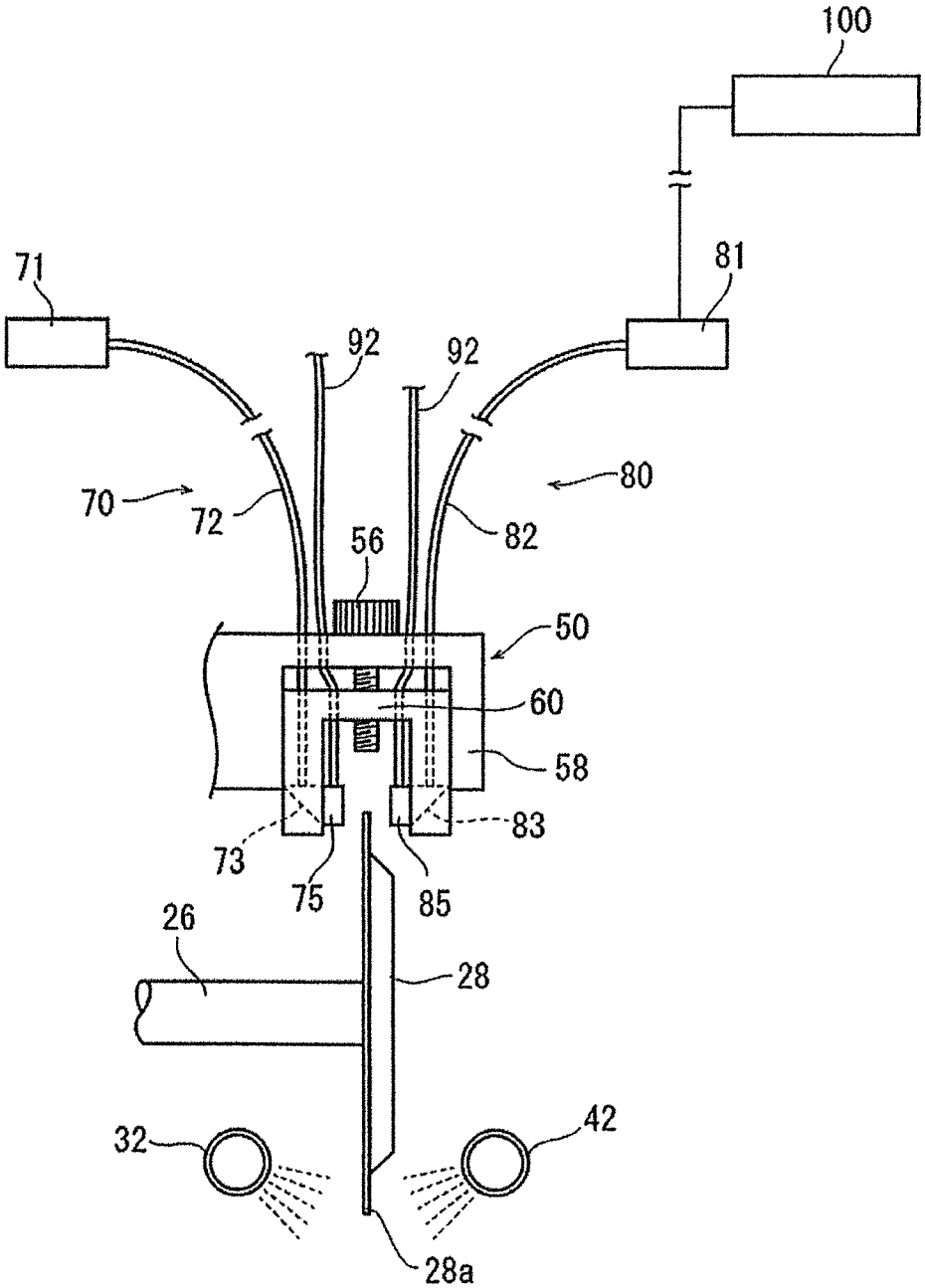
FIG. 3 is a schematic diagram illustrating a mechanism of a blade monitor in the cutting apparatus depicted in FIG. 1.
Figure 4:
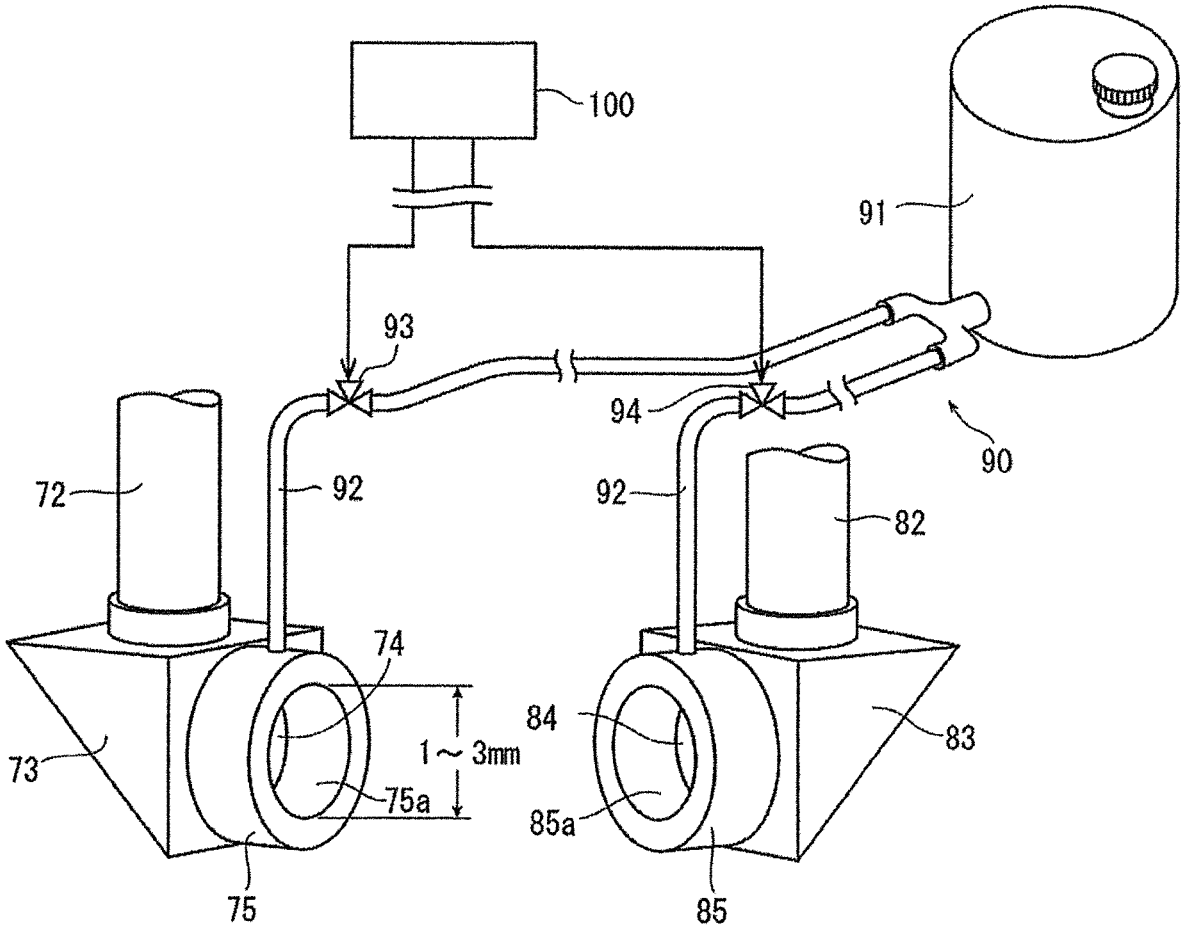
FIG. 4 is a perspective view illustrating the mechanism of the blade monitor as depicted in FIG. 3.

As depicted in FIGS. 3 and 4, the blade monitor 50 includes a light-emitting section 70 and a light-receiving section 80. The light-emitting section 70 is configured of a light-emitting element 71 formed from a light-emitting diode (LED), a laser diode (LD) or the like, an optical fiber 72 connected to the light-emitting element 71, a right-angle prism 73 attached to the moving block 60 for reflecting, at a right angle, light from the optical fiber 72, a light-emitting end face 74 constructed of a plate of sapphire or the like and bonded on a light-emitting surface of the right-angle prism 73, and a first ring member 75 defining a recessed portion 75*a* in a surface of the light-emitting end face 74. On the other hand, the light-receiving section 80 is configured of a light-receiving element 81 such as a photodiode (PD), an optical fiber 82 connected to the light-receiving element 81, a right-angle prism 83 with the optical fiber 82 connected thereto, the right-angle prism 83 being attached to the moving block 60, a light-receiving end face 84 constructed of a plate of sapphire or the like and bonded on a light-receiving surface of the right-angle prism 83, and a second ring member 85 defining a recessed portion 85*a* in a surface of the light-receiving end face 84.

The light entered from the light-receiving end face 84 is reflected by a reflecting surface of the right-angle prism 83, and is guided to the light-receiving element 81 via the optical fiber 82. The light-receiving element 81 is connected to the control unit 100, and the quantity of light (current value) detected by the light-receiving element 81 is transmitted to the control unit 100 and is stored in a storage section. The recessed portions 75*a* and 85*a* are formed with a diameter dimensioned at 1 to 3 mm or so. In FIG. 4, the right-angle prism 73 and the right-angle prism 83 are arranged at angles different from actual angles for the convenience of description. Actually, the light-emitting end face 74 as an end face on the side of the light-emitting section 70 and the light-receiving end face 84 as an end face on the side of the light-receiving section 80 are arranged in parallel to each other such that they oppose each other with the cutting blade 28 interposed therebetween.

Further, the blade monitor 50 includes a rinsing water supply mechanism 90 for supplying rinsing water R to the recessed portion 75*a* formed by the first ring member 75 and the recessed portion 85*a* formed by the second ring member 85.

Figure 5:
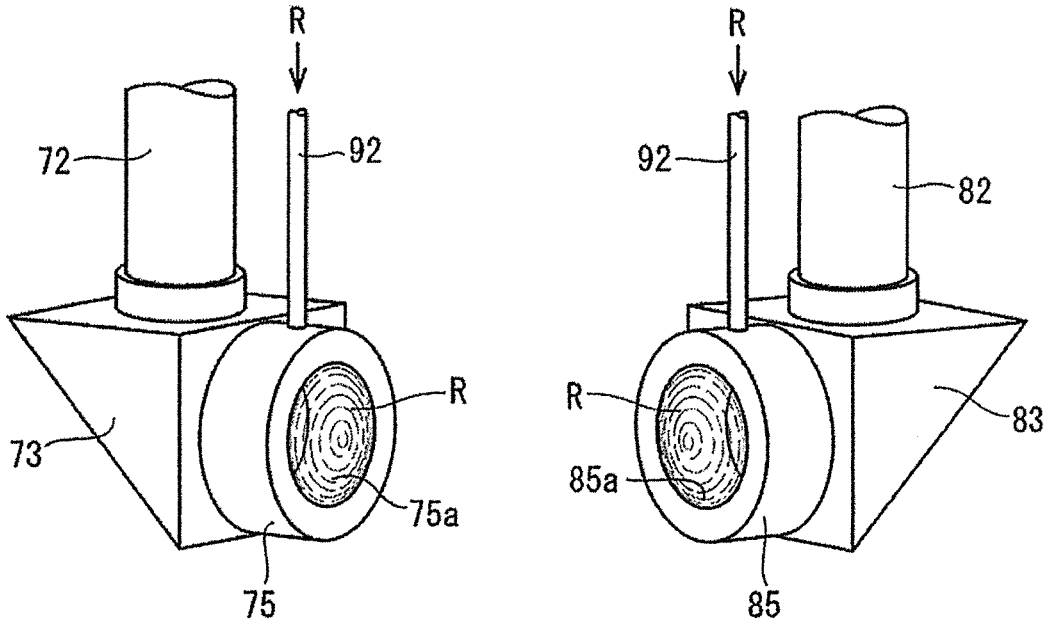
FIG. 5 is a perspective view illustrating a state that rinsing water has been supplied to recessed portions of the blade monitor as depicted in FIG. 4.

As depicted in FIG. 4, the rinsing water supply mechanism 90 is configured of a rinsing water storage tank 91 that stores the rinsing water R, tubes 92 that guide the rinsing water R from the rinsing water storage tank 91 to the recessed portions 75*a* and 85*a*, and on/off valves 93 and 94 that are arranged on the tubes 92. As depicted in FIG. 5, the tubes 92 are connected to the first ring member 75 and second ring member 85 that define the recessed portions 75*a* and 85*a*, and open/closure operation of the on/off valves 93 and 94 is controlled by a control unit 100 configured of a computer so that the rinsing water R is supplied to the recessed portions 75*a* and 85*a*. The supply of the rinsing water R is basically conducted when the rotation of the cutting blade 28 is stopped. When the rinsing water R is supplied, the rinsing water R is retained under the action of surface tension in the recessed portions 75*a* and 85*a* as depicted in FIG. 5. The rinsing water R may preferably contain diluted fluoric acid. Even if swarf of silicon (Si) which forms the wafer W adheres, the use of diluted fluoric acid as the rising water R makes it possible to dissolve it.

As depicted in FIGS. 3 and 4, the light-emitting end face 75*a* of the light-emitting section 70 and the light-receiving end face 85*a* of the light-receiving section 80 are arranged such that they flank a perimeter portion of the cutting edge 28*a* of the cutting blade 28. Moreover, it is set that light irradiated from the light-emitting end face 75*a* passes close to the perimeter portion of the cutting edge 28*a*. If chipping or wearing occurs on the cutting edge 28*a*, the quantity of light that passes close to the perimeter portion of the cutting edge 28*a* increases, and therefore the chipping or wearing can be detected. Upon detection of the chipping or wearing of the cutting edge 28*a*, an alarm is issued by alarm means included in the control unit 100, and the operator replaces the cutting blade 28 by a new cutting blade.

The positions of the light-emitting end face 74 and the light-receiving end face 84 relative to the cutting edge 28*a* of the cutting blade can be adjusted by turning the adjustment screw 56. Upon replacement of the cutting blade 28, the operator removes the detachable cover 40 from the blade cover 30 as illustrated in FIG. 2A, and in this state, replaces the cutting blade 28. The cutting apparatus 2 according to the present embodiment is configured basically as described above. A description will next be made about basic operation and functions of the cutting apparatus 2, first with reference to FIG. 1.

Each wafer W placed in the wafer cassette 8 is grasped at the frame F thereof by the transfer in/out unit 10, the transfer in/out unit 10 is moved to rear of the apparatus (in the Y-axis direction), and its grasp is then released at the temporary placing region 12, whereby the wafer W is placed on the temporary placing region 12. The registration units 14 are then moved in directions coming close to each other so that the wafer W is positioned at the predetermined location.

Then, the frame F is held under suction by the transfer unit 16, and the transfer unit 16 is turned so that the wafer W which is integral with the frame F is transferred to the chuck table 18 and is held by the chuck table 18. Thereafter, the chuck table 18 is moved in the X-axis direction and the wafer W is positioned right underneath the alignment unit 20. When the wafer W has been positioned right underneath the alignment unit 20, the image capture unit 22 captures an image of the surface of the wafer W. The captured image is displayed on the undepicted display means to perform retrieval for key patterns to be used as targets in pattern matching. These key patterns use, for example, characteristic parts in circuits of the devices D formed on the wafer W, individually.

Upon determination of the key patterns by the operator, the image including the key patterns is stored in the storage section included in the control unit 100 of the cutting apparatus 2. Further, the distance between desired one of the key patterns and a center line of the two planned dividing lines on opposite sides of the desired key pattern is determined based on coordinate values or the like, and the value of the distance is also stored beforehand. After preparations for pattern matching from the captured image have been completed as described above, the chuck table 18 is moved in the X-axis direction, followed by pattern matching between two points which are substantially apart from each other in the X-axis direction on desire one of the planned dividing lines.

Upon completion of the pattern matching between the two points, a straight line that connects desired two of the key patterns to each other is now in parallel to all the planned dividing lines. The cutting unit 24 is then moved in the Y-axis direction by the distance between the desired one key pattern and the center line of the two planned dividing lines, whereby the alignment between the planned dividing line, along which cutting is about to be performed, and the cutting blade 28 is completed.

In the state that the alignment between the planned dividing line, along which cutting is about to be performed, and the cutting blade 28 has been performed, the chuck table 18 is moved in the X-axis direction and the cutting unit 24 is lowered while rotating the cutting blade 28 at high speed. As a consequence, cutting is performed along the planned dividing line the alignment of which has been completed.

As depicted in FIG. 3, upon cutting by the cutting blade 28 along the planned dividing line, the cutting along the planned dividing line is performed while ejecting cutting water toward the cutting blade 28 and wafer W from the cutting water supply nozzles 32 and 42. The cutting blade 28 is cooled by ejecting cutting water against the cutting blade 28.

By repeatedly performing cutting while subjecting the cutting unit 24 to index feeding in the Y-axis direction by the pitch of the planned dividing lines as stored in the storage section, cutting is completed along all the planned dividing lines in the same direction. When the chuck table 18 is turned by 90 degrees and cutting is then performed in a similar manner as described above, cutting is completed along all the planned dividing lines orthogonal to the planned dividing lines along which cutting has been completed before, so that the wafer W is divided into chips having the individual devices D.

After the completion of the cutting, the chuck table 18 is moved in the X-axis direction. Then, the wafer W is grasped by the transfer unit 25 that is movable in the Y-direction, and is transferred to a rinsing apparatus 27. At the rinsing apparatus 27, the wafer W is rinsed by rotating it at low speed (for example, 300 rpm) while spraying water from a rinsing nozzle.

After the rinsing, the wafer W is dried by blowing air from an air nozzle while rotating the wafer W at high speed (for example, 3,000 rpm). Subsequently, the wafer W is held under suction by the transfer unit 16 and is returned to the temporary placing region 12, and is then returned to the original placing location in the wafer cassette 8 by the transfer in/out unit 10.

Referring to FIGS. 3 to 5, a more specific description will next be made about operation and functions of the blade monitor 50 in the present embodiment. Upon operating the cutting apparatus 2 for the first time after setting the new cutting blade 28, initial setting of the blade monitor 50 is first performed by moving the moving block 60 in the direction of an axis of rotation of the cutting blade 28 to position the light-emitting end face 74 of the light-emitting section 70 and the light-receiving end face 84 of the light-receiving section 80 at locations where they oppose each other with the perimeter portion of the cutting edge 28*a* being interposed therebetween. Specifically, the moving block 60 is moved in the direction of the axis of rotation of the cutting blade 28 to position the light-emitting end face 74 of the light-emitting section 70 and the light-receiving end face 84 of the light-receiving section 80 at locations close to the cutting edge 28*a*.

Light is then emitted from the light-emitting element 71, and the value of the quantity of light received by the light-receiving element 81 is transmitted to the control unit 100. In the storage section of the control unit 100, the value of a quantity of light as an initial criterion for light to be received at the light-receiving element 81 is stored, and a comparison is made between the value of the quantity of light received at the light-receiving element 81 and the value of the quantity of light as the initial criterion. Here, the quantity of light which is to pass close to the perimeter portion of the cutting edge 28*a* can be controlled by turning the adjustment screw 56 to adjust the positions of the light-emitting end face 74 and the light-receiving end face 84 in the upward/downward direction. When the quantity of light detected at the light-receiving element 81 is determined to coincide with the quantity of light as the initial criterion, in other words, if the blade monitor 50 is determined to be in a desired state that allows light, which is irradiated from the light-emitting element 71, to slightly pass close to the perimeter portion of the cutting edge 28*a* and to reach the light-receiving element 81, the blade monitor 50 is determined to have been set in a predetermined initial state. In the present embodiment, the adjustment screw 56 is described to be turned manually. It may, however, be configured to electrically drive the adjustment screw 56 by a pulse motor or the like and to control it by the control unit 100.

In the present embodiment, the rinsing water supply mechanism 90 is actuated to supply the rinsing water R to the recessed portions 75*a* and 85*a* in the state that rotation of the cutting blade 28 is stopped. Specifically, an instruction signal is fed from the control unit 100 to the on/off valves 93 and 94 so that the rinsing water R is supplied in amounts sufficient to fill up the volumes of the recessed portions 75*a* and 85*a*. The amounts of the rinsing water R to be fed to the recessed portions 75*a* and 85*a* by the rinsing water supply mechanism 90 may preferably be the amounts sufficient to exactly fill up the recessed portions 75*a* and 85*a*, and the rinsing water R is retained under the action of surface tension in the recessed portions 75*a* and 85*a*. If the rinsing water R is supplied as described above, the light-emitting end face 74 and the light-receiving end face 84 located in the recessed portions 75*a* and 85*a* are rinsed. As the timing of supplying the rinsing water R, it is preferred to conduct the supply of the rinsing water R when the cutting apparatus 2 is stopped after finishing cutting work for the day and/or when the cutting apparatus 2 is stopped for a temporary period of time because of a lunch break or the like. In this manner, the washing water R can be retained for a long period of time in the recessed portions 75*a* and 85*a*, and swarf adhered on the light-emitting end face 74 and the light-receiving end face 84 can be eliminated. Especially when swarf is composed of Si, Si is dissolved and eliminated with diluted fluoric acid. In the present embodiment, the plates of sapphire, which is resistant to diluted fluoric acid, are adopted as the light-emitting end face 74 and the light-receiving end face 84, and therefore the light-emitting end face 74 and the light-receiving end face 84 are not dissolved with diluted fluoric acid.

When practicing cutting, cutting water is supplied to the cutting edge 28*a* and positions on the wafer W, where the wafer W is to be cut, from the cutting water supply nozzles 32 and 42 as described above. As the cutting blade 28 is rotating at high speed, the cutting water supplied to the cutting edge 28*a* is caused to scatter. The rinsing water R supplied to and retained in the recessed portions 75*a* and 85*a* is removed by the scattering cutting water. By periodically supplying the rinsing water R to the recessed portions 75*a* and 85*a*, however, the rinsing of the light-emitting end face 74 and the light-receiving end face 84 is carried out so that they can retain a rinsed state.

If cutting is repeatedly performed and wearing of the cutting edge 28*a* proceeds, the quantity of light to be received at the light-receiving element 81 gradually increases, and hence the value of a current to be outputted from the light-receiving element 81 to the control unit 100 also increases gradually. If the wear of the cutting edge 28*a* reaches a limit value, the quantity of light detected by the light-receiving element 81 exceeds a threshold quantity of light stored beforehand for the determination of wearing in the control unit 100, a display is made on the undepicted display means by the control unit 100 to indicate that the wearing of the cutting blade 28*a* has proceeded to its replacement time, and moreover an alarm is issued to the operator by alarming means such as a buzzer or lamp.

The output from the light-receiving element 81 is also used for the detection of damage to the cutting blade 28. This damage detection is to detect chipping of the cutting edge 28*a*. If chipping occurs on the cutting edge 28*a*, the value of a current outputted from the light-receiving element 81 is detected to change in spike shape (suddenly increases and then decreases). If the value of a current outputted from the light-receiving element 81 is monitored by the control unit 100 and a spike-shaped change in the current value is detected, the cutting edge 28*a* is determined to have developed chipping, the cutting is interrupted immediately, and the occurrence of chipping is displayed on the undepicted display means. This display can urge the operator to replace the cutting blade 28 by a new cutting blade so that the productivity of cutting wafers W is improved.

In the embodiment described above, the use of diluted fluoric acid as the rinsing water R is described by way of example. However, the diluted fluoric acid used as the rinsing water R is in an extremely small amount, and moreover is diluted further with a large amount of cutting water. Its toxicity is, therefore, lowered significantly. Nonetheless, when disposing of waste water, it is preferred to dispose of the waste water by neutralizing fluoric acid, which is contained in the waste water, with lime milk, soda ash or the like, and then further diluting the neutralized waste water with water.

In the embodiment described above, it is described by way of example to use plates of sapphire, which is not dissolved even with diluted fluoric acid, or the like as the light-emitting end face 74 and the light-receiving end face 84 and also to use diluted fluoric acid as the rinsing water R. If these plates are formed from a general material such as glass, however, they may be dissolved with diluted fluoric acid so that the rinsing water R may preferably contain a surfactant instead of fluoric acid.

In the embodiment described above, the blade monitor 50 is configured to include the light-emitting element 71 in the light-emitting section 70 and the light-receiving element 81 in the light-receiving section 80 for the detection of a worn state or a chipped state of the cutting edge 28*a*. However, the present invention is not restricted to this configuration, and an image capture camera may be adopted instead of the light-receiving element 81 and an image of conditions of the cutting edge 28*a* may be captured by the image capture camera. In this modification, a plate of sapphire may be arranged on the surface of a lens of the image capture camera, a recessed portion may be formed in an end face where the plate is arranged, and rinsing water R may be supplied to the recessed portion.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting apparatus comprising:

a chuck table that holds a workpiece;

a cutting unit that subjects the workpiece, which is held on the chuck table, to cutting by rotating a cutting blade while supplying cutting water to the workpiece; and a machining feed unit that subjects the chuck table and the cutting unit to machining feed relative to each other, wherein the cutting unit includes:

a spindle with a cutting blade mounted thereon for rotation, a spindle housing that rotatably supports the spindle, a blade cover that is attached to the spindle housing and covers the cutting blade, a cutting water supply nozzle that supplies cutting water to the cutting blade, and a blade monitor that has an end face configured to monitor a cutting edge of the cutting blade, wherein the end face of the blade monitor faces the outer perimeter of the cutting edge of the cutting blade, and wherein the end face of the blade monitor has a recessed portion to which rinsing water is supplied to rinse the end face, and further wherein the rinsing water is retained in the recessed portion via surface tension, wherein the blade monitor includes a ring member that defines and surrounds the recessed portion on the end face, wherein the cutting apparatus further comprises a tube that is directly connected to the ring member, wherein the tube is configured and arranged to supply the rinsing water to the end face, and wherein an outer surface of the rinsing water is essentially flush with an outer surface of the ring member.

2. The cutting apparatus according to claim 1, wherein the rinsing water is supplied when rotation of the cutting blade is stopped.

3. The cutting apparatus according to claim 1, wherein the rinsing water includes one of diluted fluoric acid and a surfactant.

4. The cutting apparatus according to claim 1, wherein:

the cutting blade defines a plane that creates a first area on a first side of the plane and a second area on a second side of the plane, wherein the first and second areas are on opposite sides of the plane; and the recessed portion is completely located on the first side of the plane.

5. The cutting apparatus according to claim 1, wherein the recessed portion has a diameter of between 1 mm and 3 mm.

6. The cutting apparatus according to claim 1, wherein the ring member has a diameter of between 1 mm and 3 mm.

7. A cutting apparatus comprising:

a chuck table that holds a workpiece;

a cutting unit that subjects the workpiece, which is held on the chuck table, to cutting by rotating a cutting blade while supplying cutting water to the workpiece; and a machining feed unit that subjects the chuck table and the cutting unit to machining feed relative to each other, wherein the cutting unit includes:

a spindle with a cutting blade mounted thereon for rotation, a spindle housing that rotatably supports the spindle, a blade cover that is attached to the spindle housing and covers the cutting blade, a cutting water supply nozzle that supplies cutting water to the cutting blade, and a blade monitor that is configured to monitor a cutting edge of the cutting blade, wherein the blade monitor includes a light emitting section with a first end face and a light receiving section with a second end face, and further wherein the first end face faces the second end face, and wherein the first end face of the blade monitor has a first recessed portion to which rinsing water is supplied to rinse the first end face, and further wherein the rinsing water is retained in the first recessed portion via surface tension, the second end face of the blade monitor has a second recessed portion to which rinsing water is supplied to rinse the second end face, and further wherein the rinsing water is retained in the second recessed portion via surface tension, wherein the blade monitor includes:

a first ring member that defines and surrounds the first recessed portion on the first end face, wherein an outer surface of the rinsing water is essentially flush with an outer surface of the first ring member; and a second ring member that defines and surrounds the second recessed portion on the second end face, wherein an outer surface of the rinsing water is essentially flush with an outer surface of the second ring member; and wherein the cutting apparatus further comprises:

a first tube that is directly connected to the first ring member, wherein the first tube is configured and arranged to supply the rinsing water to the first end face; and a second tube that is directly connected to the second ring member, wherein the second tube is configured and arranged to supply the rinsing water to the second end face.

8. The cutting apparatus according to claim 7, wherein the rinsing water is supplied when rotation of the cutting blade is stopped.

9. The cutting apparatus according to claim 7, wherein the rinsing water includes one of diluted fluoric acid and a surfactant.

10. The cutting apparatus according to claim 7, wherein the recessed portion has a diameter of between 1 mm and 3 mm.

11. The cutting apparatus according to claim 7, wherein the first ring member and the second ring member each have a diameter of between 1 mm and 3 mm.

* * * * *